US005306881A

United States Patent [19]

Kiyooka

[11] Patent Number: 5,306,881

[45] Date of Patent: Apr. 26, 1994

[54] EXHAUST SILENCER WITH SPARK ARRESTER

[75] Inventor: Katsumi Kiyooka, Togane, Japan

[73] Assignee: Maruyama Mfg., Co., Ltd., Togane, Japan

[21] Appl. No.: 37,386

[22] Filed: Mar. 26, 1993

[30] Foreign Application Priority Data

Mar. 27, 1992 [JP] Japan ..... 4-25369

[51] Int. Cl.[5] ..... F01N 7/08

[52] U.S. Cl. ..... 181/227; 181/228; 181/231

[58] Field of Search ..... 181/227, 228, 231, 241, 181/243, 252, 222, 247, 248, 256, 258, 282; 55/276, 279, DIG. 20, 525

[56] References Cited

U.S. PATENT DOCUMENTS 1,532,473 4/1925 Byrne ..... 181/231

4,872,528 10/1989 Goplen et al. ..... 181/228

FOREIGN PATENT DOCUMENTS 3-50254 10/1991 Japan .

3-50255 10/1991 Japan .

*Primary Examiner*—Michael L. Gellner

*Assistant Examiner*—Khanh Dang

*Attorney, Agent, or Firm*—Cushman, Darby & Cushman

[57] ABSTRACT

A spark arrester is mounted in a tail pipe of an exhaust pipe of an engine, in particular a 2-strokecycle engine, and prevents sparks from being emitted. The spark arrester includes a sack-like member of a wire mesh and a cylindrical member secured to open end of the sack-like member. The cylindrical member received in the tail pipe is retained therein by a resilient retainer in a groove formed in the inner peripheral wall of the tail pipe.

2 Claims, 3 Drawing Sheets

EXHAUST SILENCER WITH SPARK ARRESTER

BACKGROUND OF THE INVENTION

The present invention relates to an exhaust silencer for an internal combustion engine, in particular a 2-stroke cycle engine and, more particularly, to an improvement in the construction of a spark arrester which is attached to the tail pipe of an exhaust silencer and which prevents exhaust sparks from being emitted from the silencer.

Japanese Utility Model Publication Nos. 3-50254 and 3-50255 disclose exhaust silencers having spark arresters.

More specifically, the exhaust silencer disclosed in Japanese Utility Model Publication No. 3-50254 has, as shown in FIG. 6 of the present application, a spark arrester c comprising a wire mesh screen a and a pipe b. The spark arrester c is attached to a tail pipe d of the exhaust silencer by means of a screw e extending laterally through the wall of the tail pipe d. Referring now to FIG. 7 of this application, the exhaust silencer disclosed in Japanese Utility Model Publication No. 3-50255 has a spark arrester g inserted into an exhaust pipe f. A sleeve-like member h is elastically fitted over the outer surface of the exhaust pipe f so that the spark arrester g is elastically retained in the exhaust pipe f.

The spark arrester c shown in FIG. 6 is disadvantageous in that it is not easy to set or remove the screw e through the exhaust opening in the direction perpendicular to the axis of the tail pipe d, although insertion and withdrawal of the spark arrester c can be done without difficulty. The known spark arrester of the type shown in FIG. 7 also is disadvantageous in that the construction is complicated due to the use of the sleeve-like member adapted to be fitted over the outer surface of the exhaust pipe h and high degree of dimensional precision is required to realize a tight fit between the spark arrester g and the exhaust pipe f. In addition, stick tends to occur due to corrosion between the sleeve-like member h and the exhaust pipe f and between the spark arrester g and the exhaust pipe f, making it difficult to detach the spark arrester g from the exhaust pipe f. In addition, the described support structure for supporting the spark arrester of the type shown in FIG. 7 cannot provide stable and constant force required for retaining the spark arrester in the exhaust pipe.

SUMMARY OF THE INVENTION

Accordingly, an object of the present invention is to provide an exhaust silencer which has a spark arrester improved to eliminate the above-described drawbacks of the known art.

To this end, according to the present invention, there is provided an exhaust silencer comprising: a tail pipe having an annular groove formed in the inner peripheral surface thereof; a spark arrester including a sack-like member of a wire mesh and a cylindrical member secured to the sack-like member at its open end, the spark silencer being mounted in the tail pipe; and a resilient retainer fitted in the annular groove for retaining the cylindrical member so as to prevent the spark arrester from coming off the tail pipe.

In a specific embodiment of the invention, the cylindrical member has a substantially T-shaped tab projecting from one end face thereof, while the resilient retainer is of a ring-like form which is interrupted at an intermediate portion thereof to provide opposite ends of the retainer, the opposite ends of the resilient retainer being received in recesses defined between the end face of the cylindrical member and the T-shaped tab.

According to the invention, a spark arrester can easily be mounted in and demounted from an exhaust pipe through its open end, and can be retained by the resilient retainer fitted in the annular groove, without any difficulty.

The above and other objects, features and advantages of the present invention will become clear from the following description of the preferred embodiments taken in conjunction with the accompanying drawings.

DESCRIPTION OF THE PREFERRED EMBODIMENTS

Figure 1:
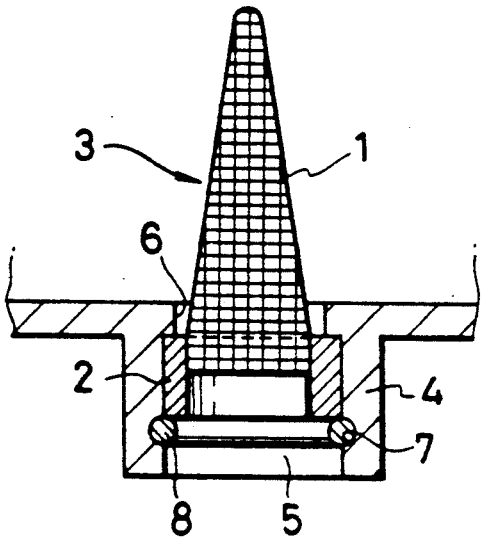
FIG. 1 is a sectional view of a critical portion of an embodiment of the present invention.

Referring first to FIG. 1, a spark arrester 3 comprises a sack-like member 1 of a wire mesh and a cylindrical member 2 secured to the sack-like member at its open end. The spark arrester 3 is adapted to be mounted in a tail pipe 4 of an exhaust silencer, through the open end 5 of the tail pipe 4. The tail pipe 4 is provided on its inner peripheral surface with a step 6 and an inner annular groove 7 formed in the inner surface of the tail pipe. Mounting of the spark arrester 3 is effected by inserting spark arrester 3 through the open end 5 into the tail pipe 4 until it is stopped by the step 6 of the inner surface of the tail pipe 4. Then, a snap ring 8, as a resilient retainer, is fitted into the annular groove 7. The snap ring 8 is partly received in the retaining groove 7 so that the outer end of the cylindrical member 2 is retained by the portion of the snap ring 8 which projects from the groove 7.

Figure 2:
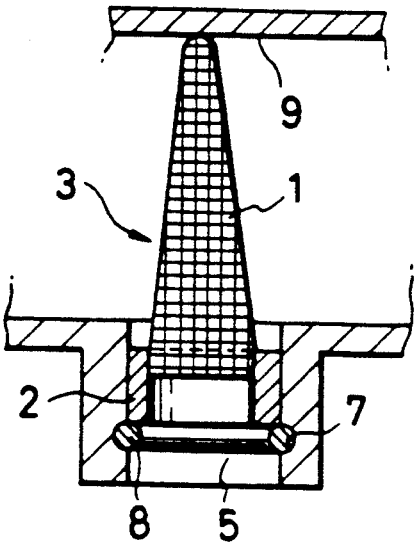
FIG. 2 is a sectional view of a critical portion of another embodiment of the present invention.

FIG. 2 shows another embodiment in which the inner end of the sack-like member 1 of the spark arrester abuts an inner wall 9 of the exhaust silencer. In this embodiment, therefore, the step 6 of the inner peripheral surface of the tail pipe 4 in the first embodiment is omitted.

Figure 3:
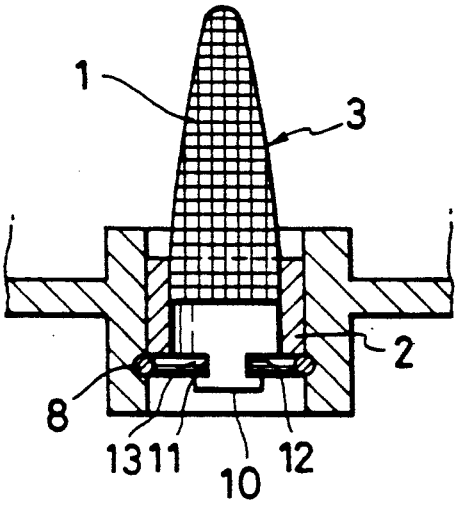
FIG. 3 is a sectional view of critical portion of still another embodiment of the present invention.
Figure 4:
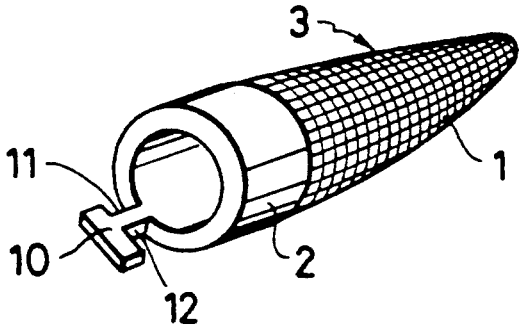
FIG. 4 is a perspective view of a spark arrester used in the embodiment shown in FIG. 3.

FIG. 3 and 4 shows still another embodiment in which a substantially T-shaped tab 10 is formed to project from the end surface of the cylindrical member 2. In use, the opposite ends of the resilient retainer 8, which defines an interrupted portions 13 in the retainer, engage both recesses 11 and 12 defined between the end face of the cylindrical member 2 and the tab 10, thus preventing play or movement of the spark arrester 3 particularly in the circumferential direction.

Figure 5A:
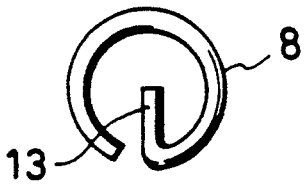
FIG. 5(*a*) to 5(*c*) are illustrations of different examples of a resilient retainer for use with the spark arrester according to the present invention.
Figure 5B:
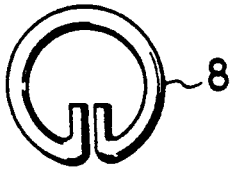
Figure 5C:
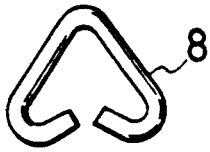
Figure 6:
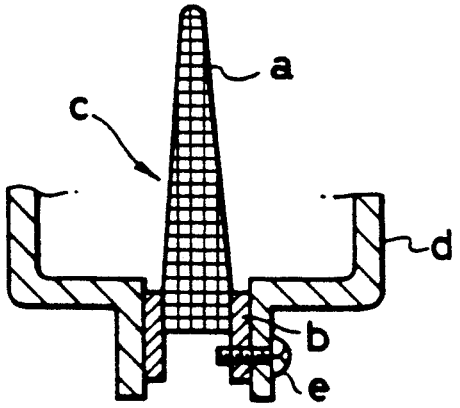
FIG. 6 ( PRIOR ART )
FIG. 6 is a sectional view of a known structure for supporting a spark arrester in an exhaust pipe.
Figure 7:
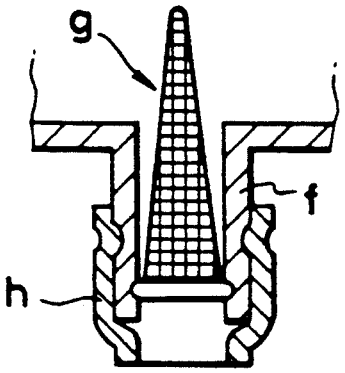
FIG. 7 ( PRIOR ART )
FIG. 7 is a sectional view of another known structure for supporting a spark arrester in an exhaust pipe.

The resilient retainer 8 can take various forms such as those shown in FIG. 5(*a*) to 5(*c*) by way of examples. Ring-shaped members generally known as snap rings can suitably be used as the resilient retainer 8. Among various forms of resilient retainers, the retainer shown in FIG. 5(*a*), having one end extending towards the center of the circle to form a tab 13, may be fitted in the exhaust pipe even when the spark arrester is not used, for the purpose of preventing nesting by bees invading the exhaust pipe.

According to the invention, it is possible to easily mount and demount the spark arrester in and out of the tail pipe of an exhaust silencer through the open end of the tail pipe. This advantageously facilitates various works such as inspection and repair of the exhaust silencer and the spark arrester.

What is claimed is:

1. An exhaust silencer comprising:

a tail pipe having an annular groove formed on an inner peripheral surface thereof;

a spark arrester including a sack-like member of a wire mesh and a cylindrical member secured to the sack-like member at an open end of said sack-like member, said spark arrester being mounted in said tail pipe; and a resilient retainer fitted in said groove for retaining said cylindrical member so as to prevent said spark arrester from coming off said tail pipe.

2. An exhaust silencer according to claim 1, wherein said cylindrical member has an end face and a substantially T-shaped tab projecting from said end face thereof, while said resilient retainer is of a split ring-like form opposing ends, said opposing ends of said resilient retainer being fitted in recesses defined between the end face of said cylindrical member and said T-shaped tab.

* * * * *